United States Patent [19]

Harigai et al.

[11] Patent Number: 4,477,999

[45] Date of Patent: Oct. 23, 1984

[54] TRANSFORMABLE TOY VEHICLE

[75] Inventors: Akinori Harigai; Shinichi Aoki; Takehisa Nakayama, all of Tokyo, Japan

[73] Assignee: Kabushiki Kaisha BANDAI, Tokyo, Japan

[21] Appl. No.: 528,476

[22] Filed: Sep. 1, 1983

[30] Foreign Application Priority Data

Mar. 10, 1983 [JP] Japan ..... 58-39901

[51] Int. Cl.[3] ..... A63H 11/10

[52] U.S. Cl. ..... 446/470

[58] Field of Search ..... 46/201, 202, 115, 116, 46/17, 206, 251, 1 R; 273/155

[56] References Cited

U.S. PATENT DOCUMENTS 3,748,780 7/1973 Glass et al. ..... 46/202

FOREIGN PATENT DOCUMENTS 2060414 5/1981 United Kingdom ..... 46/215

*Primary Examiner*—Mickey Yu

*Attorney, Agent, or Firm*—Armstrong, Nikaido, Marmelstein & Kubovcik

[57] ABSTRACT

A transformable toy vehicle is presented which can assume the form of two extraordinarily different appearances from each other by converting the mutual arrangement of particular elements constituting the toy vehicle. The toy vehicle comprises a chassis capable of being extended and contracted along the longitudinal direction of the car, a rear body of the car mounted on the chassis for turning upside down and reversing front and rear faces to assume two different outer appearances for top and rear faces and for bottom and front faces, respectively, and a seat member mounted generally centrally on the chassis for moving vertically and horizontally relative to the chassis.

2 Claims, 6 Drawing Figures

TRANSFORMABLE TOY VEHICLE

BACKGROUND OF THE INVENTION

The present invention relates to a transformable toy vehicle which can assume the form of two extraordinarily different appearances from each other by converting the mutual arrangement of particular elements constituting the toy vehicle.

There are various kinds of transformable toy vehicles known in the art. Most of such toy vehicles are featured in that the form conversion is mainly restricted only to the change of the outer appearance thereof, the conversion of which is carried out by adding or deleting one or more of the constituting elements of the toy vehicles. Therefore, a toy vehicle of this kind lacks unity as a whole, and is expensive because of an increase of additional elements, when compared with a toy of the kind that can assume the different outer posture from the previous one which was attained by changing the mounting position of the same element or elements without adding or deleting the number of elements constituting the toy.

Transformable toy vehicles the conversion of which can be effected without varying the number of elements, that is, without adding or deleting the constitutional elements, are mostly of the type in which the form of a car is converted into other forms other than that of the car. For example, the form of a sport car is converted into a robot form.

On the contrary to the above, form conversion for the same categories, such as conversion from one type of a car to another type of a car, is rare. Moreover, in this case it is often true that the degree of form change can be recognized only a little which necessarily leads to wanting in interest. The reason is that it is very difficult to transform characteristic elements which constitute essential parts of a car, such as seat or the like, which maintaining a visual image of characteristic features of the car. More in particular, for example, the seat of the car is always recognized as a seat even before or after the form conversion, which restrains the freedom of form conversion design.

SUMMARY OF THE INVENTION

It is, therefore, a principal object to provide a transformable toy vehicle which can assume remarkably different two outer appearances, such as hatch-back type and van type car postures. In order to carry out the above object, a rear chassis of the car is formed to have two different outer appearances and is reversibly mounted on a chassis which is formed extendably and contractably along the longitudinal direction of the car, and a seat portion member is mounted on the chassis, movably upward and downward, and forward and backward directions relative to the chassis.

The foregoing and other objects, the features and the advantages of the present invention will be pointed out in, or apparent from, the following description of the preferred embodiment considered together with the accompanying drawings.

DETAILED DESCRIPTION OF THE PREFERRED EMBODIMENT

Figure 1:
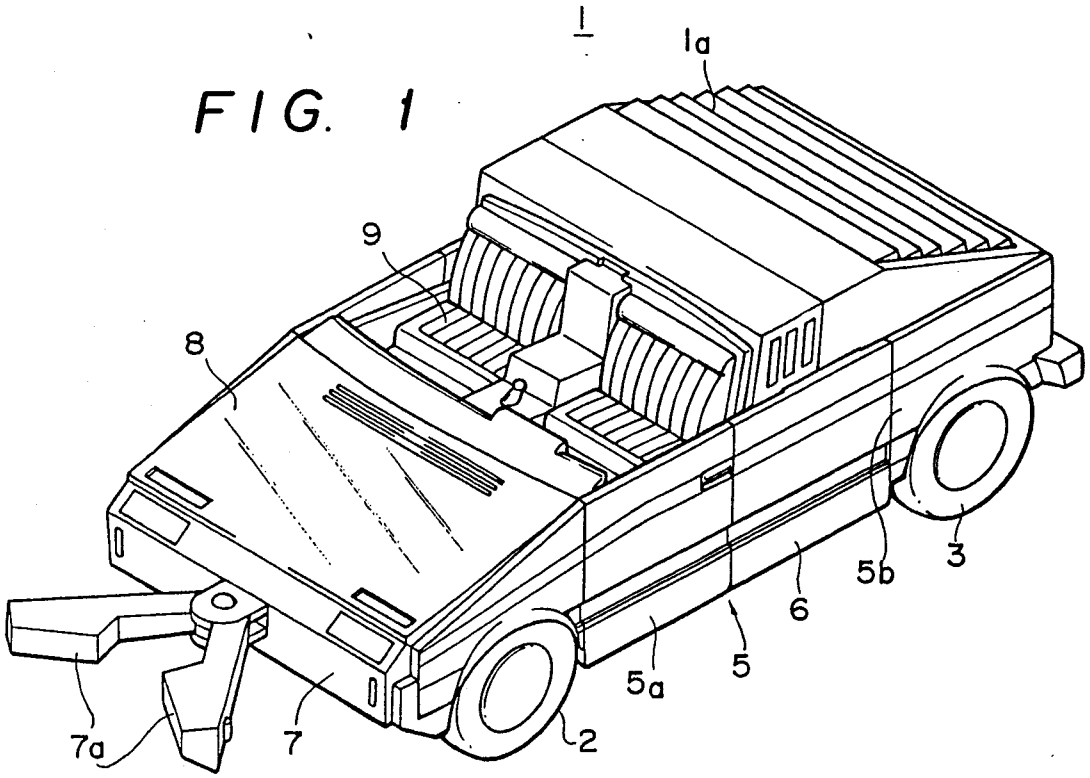
FIG. 1 is a perspective view of a first posture of one embodiment of the transformable toy vehicle according to the present invention.
Figure 2:
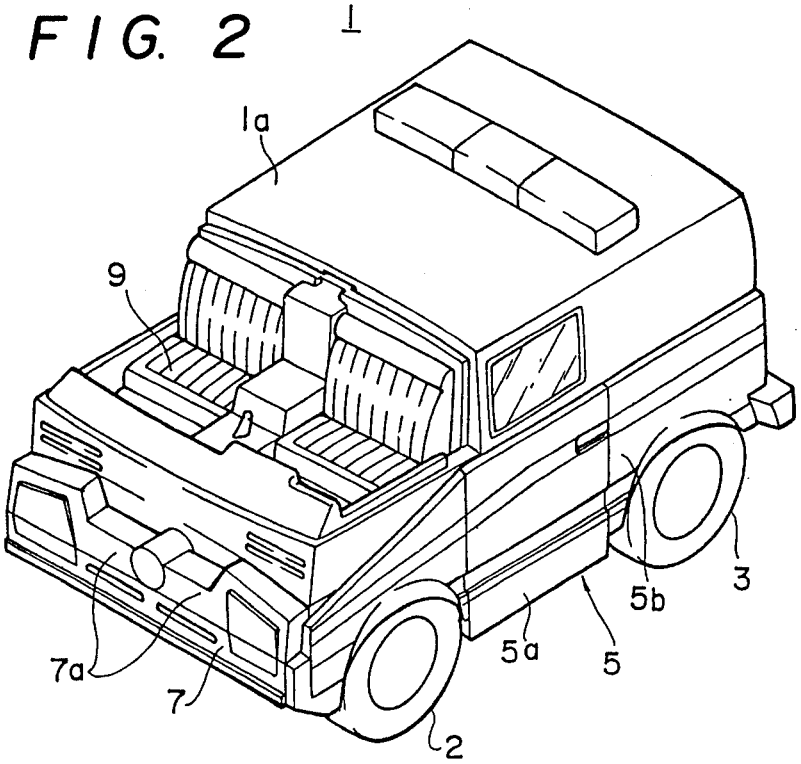
FIG. 2 is a perspective view of a second posture of the one embodiment of the transformable toy vehicle according to the present invention.

More detailed description of one embodiment of the present invention will now be given in conjunction with the accompanying drawings. In FIGS. 1 and 2, a toy vehicle 1 can take two outer postures, the first posture being a hatch-back type car and the second posture being a van type car. The two postures can be obtained by changing the usage of the rear body into either one of hatch-back type or van type car rear bodies, by reversing the front and back sides as well as the upper and lower sides of the rear body. The conversion other than the above is further carried out by changing the position and direction of other constituting elements the usage of which is not changed even before and after the form conversion. Thus, only the rear body has two different outer appearances, one being that of the hatch-back type car and the other being that of the van type car.

Figure 3:
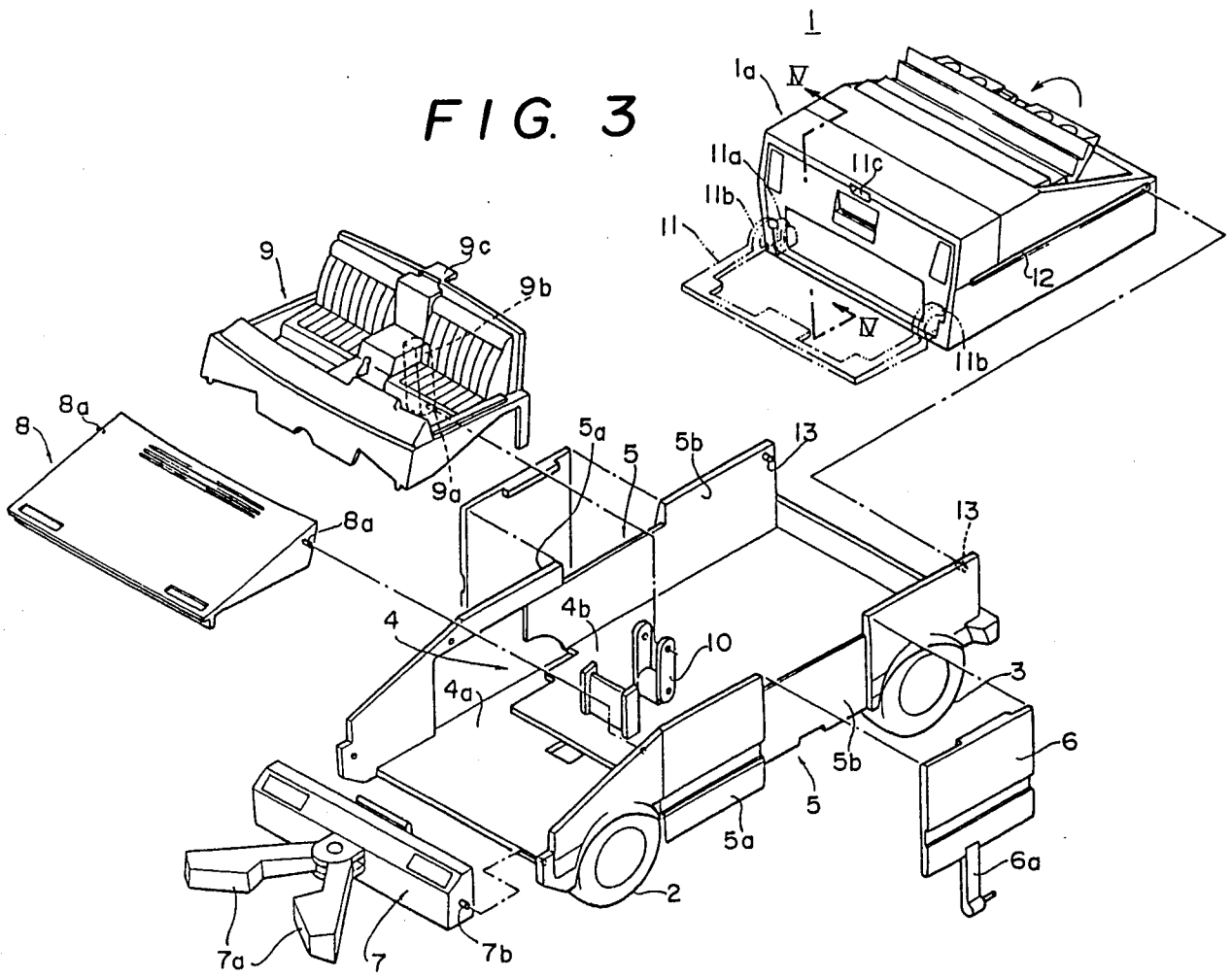
FIG. 3 is an exploded perspective view of the transformable toy vehicle shown in FIG. 1.

The construction of the first type posture of the hatchback type car is described in conjunction with FIG. 3. The transformable toy vehicle 1 has as main parts thereof a front wheel 2, a rear wheel 3, and a chassis 4 made of a plastic plate capable of being extended or contracted when the vehicle is transformed. The chassis 4 is integrally formed with a side panel 5, and also has front and rear chassis 4*a* and 4*b* each dividably engaging with each other. In the present embodiment, the rear chassis 4*b* is slidably mounted on the front chassis 4*a* so as to be capable of being slidably engaged with the surface of the front chassis 4*a*, and a rear side panel 5*b* is mounted so as to be capable of slidably moving along the inner surface of the front side panel 5*a* having a door. In order to maintain a uniformity of the outer appearance, the portion of the rear side panel 5*b*, where overlaps the front side panel 5*a* when the former is contracted along the inner surface of the latter, is arranged to be covered by an ornamental panel 6 having the similar outer appearance as that of the front side panel 5*a*. The panel 6 is mounted, pivotally within about 90 degrees, about a pivot arm 6*a* one end of which is pivotted at the bottom of the rear chassis 4*b* and the other end serves as the pivot arm 6*a*. Thus, the ornamental panel 6*a* can be fixed adjacent to the bottom of the rear chassis 4*b* upon movement from the previous position adjacent to the rear side panel 5*b*.

The front chassis 4*a* is provided at the front end thereof with a bumper 7 having a bifurcated magic hand 7*a*. The bumper 7 is formed with pins 7*b* at opposite side ends, the pins 7*b* being inserted into apertures formed on the front side panel 4*a* and serving as a pivotal axles of about 90 degrees rotation thereabout. A front cover 8 shielding the front portion of the car body 1 is pivotally engaged with the front chassis 4*a* by means of both pins 8a, so that the cover 8 can be opened upward by handling the front side thereof.

A seat member 9 has a car driver seat and an auxiliary seat arranged side by side, the upper portion of the seat member 9 being shielded by a transparent cover (not shown). The seat member 9 is engaged through a pin 9a with the distal end of a pivot arm 10 which is pivotted at the position slightly forward of the middle section of the rear chassis 4b. The pin 9a is embedded on the lowermost portion of the column type link member 9b having a length approximate to that of the pivot arm 10 which is pivotted at the central section of the bottom of the seat member 9. Therefore, the seat member 9 can be lifted up by the same height as of the pivot arm length, by raising the pivot arm 10 over the surface of the rear front chassis 4b. Moreover, the seat member 9 can be moved freely in a circular arc about the pin 9a, the arc having the same radius as the length of the link member 9b.

Figure 4:
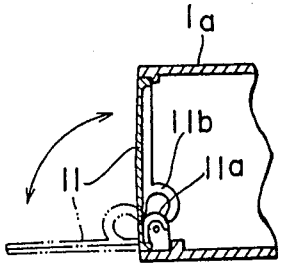
FIG. 4 is a cross sectional view taken in the direction of the arrows substantially along the line 4—4 of FIG. 3.

The rear body 1a of a hatch-back type has a rear window simulated as a sun visor. The side face of the seat member 9, where the back surface of the seat member 9 confronts, is provided with a rear door 11 which can be opened or closed. As best shown in FIG. 4, the door 11 of a gate shape has a resilient arc member 11b the end of which compressingly and frictionally engages with right and left bosses 11a of the rear body 1a. Thus, the door 11 can be opened or closed as if it is provided with a hinge having a stopper, so that the door 11 can be retained in any desired opened position or angle with the aid of the compressing force exerted by the resilient member 11b. An engaging aperture 11c is formed on the front upper middle section of the rear body 1a, the aperture 11c engaging with an engaging projection 9c formed on the middle upper portion of the seat member 9.

Guide grooves 12 are formed on the opposite side faces of the rear body 1a, horizontally extending along the entire length of the rear body 1a. The guide groove 12 engages with a guide pin 13 embedded on the rear end portion of the rear side panel 5b. As a result, owing to the above construction, that is, upon the guidance effects of the guide pin 13 and guide groove 12, the rear body 1a can be moved slidably to and fro along the rear chassis 4b. In addition, at both extreme positions where the guide pin engages with the guide groove at the front or rear end thereof, the rear body 1a can be rotated about by 180 degrees about the guide pin 13.

In the embodiment, the magic hand 7a for removing obstacles has been provided on the bumper 7 so that children may imagine a combat car attractive to them. However, other attachments, such as machine guns or heavy weapons can be housed within the rear body 1a and can bè so constructed as to be emerged therefrom when in use for battle play.

Figure 6:
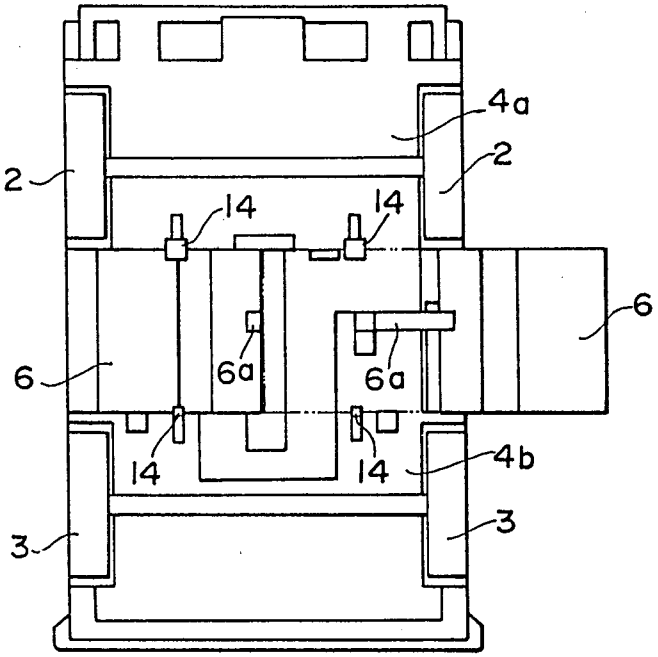
FIG. 6 is a bottom view of the toy vehicle shown in FIG. 2.
Figure 5:
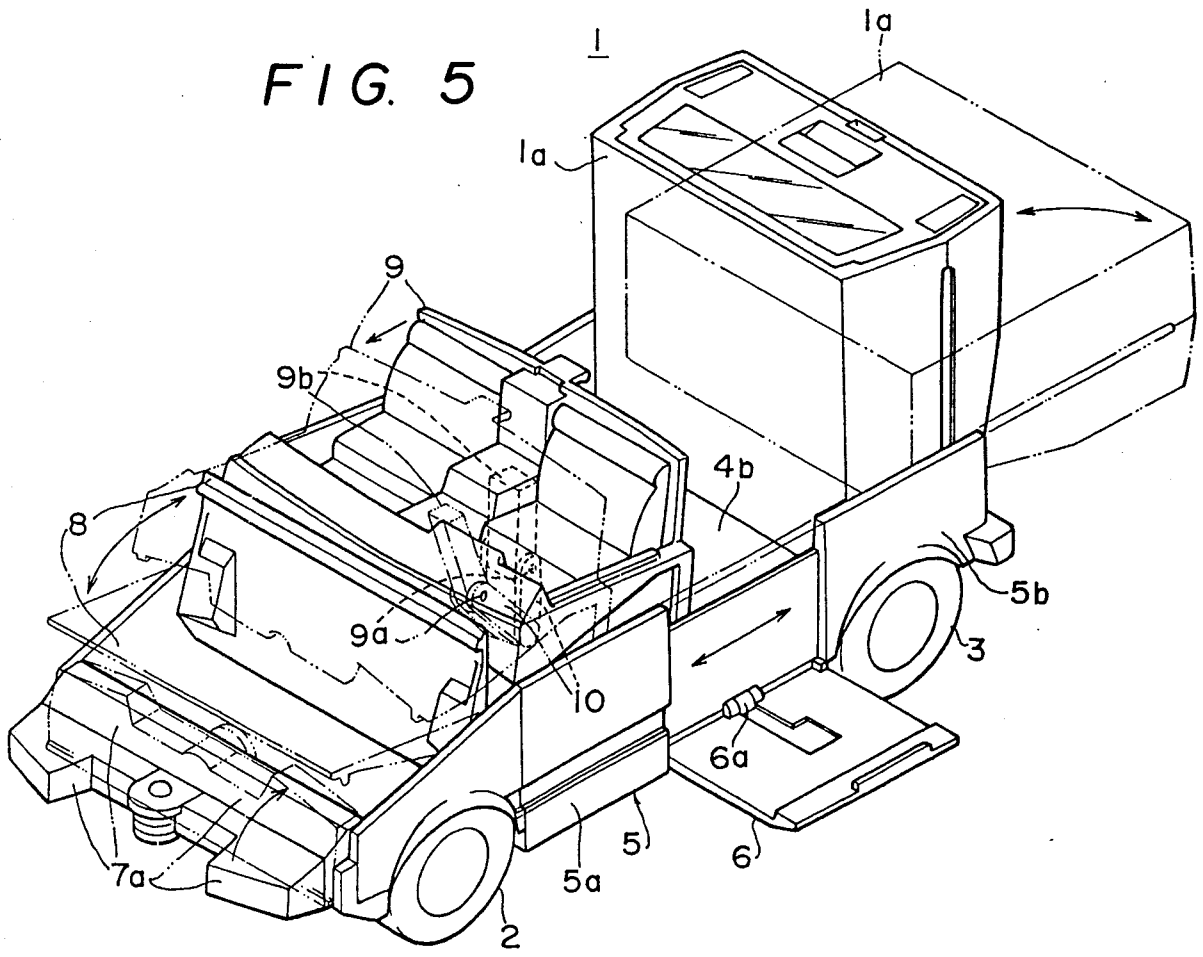
FIG. 5 is a perspective view illustrating the intermediate conversion of the transformable toy vehicle from the first posture to the second posture.

The operation of the transformable toy vehicle 1 thus constructed in which the conversion from the first posture of a hatch-back type to the second posture of a van type is carried out, will be described in conjunction with FIGS. 5 and 6.

In order to convert the car posture, necessary elements for the conversion will be moved in the order of from the elements positioned at the front of the car to the elements positioned at the rear of the car. First, the front cover 8 is lifted up in order to obtain a sufficient clearance for turning the bumper 7. Then, the magic hand 7a is swung outward by 180 degrees to abut it against the surface of the bumper 7. The bumper 7 is turned 90 degrees about the pin 7b. The above operation results in positioning the magic hand 7a to be directed upward. Thereafter, the front cover 8 is closed until it abuts against the magic hand 7a. As a result, the front cover 8 having previously been in a forward inclined state is maintained in an even state, and forms a loading surface for the seat member 9 as described hereinafter.

After the preparation for the movement of the seat member 9 is finished, the transference of the seat member 9 is to be started. Before this operation, however, the front body 1a is first released from the engagement with the seat member 9, until the guide pin 13 is moved to the position where it engages with the guide groove 12 at its front end. Next, the seat member 9 is held between fingers to raise it up. Upon completion of the above operation, the pivot arm 10 is lifted up so that the seat member 9 is moved forward by the amount equal to the movement of the pin 9a in response to the upward movement of the pivot arm 10. The seat member 9 at its upper most position is then pushed forward to be laid upon the previously evenly arranged front cover 8. In this case, the link member 9b and the pivot arm 10 are aligned in a straight line with respect to one another, moving by drawing an arc.

After completion of the transference of the elements positioned at the front side of the car, the elements at the rear side are in turn moved to transform the appearances.

First, the decorated side panel 5b covering the rear side panel 6 is turned about 90 degrees about the other end portion of the pivot arm 6a, and is positioned in alignment with the same horizontal surface as that of the rear chassis 4b. After this, as particularily shown in FIG. 6, the decorated panel 6 is swingably displaced by about 180 degrees about the one end portion of the pivot arm 6a, maintaining the panel 6 in a horizontal plane. Thus, the decorated panel 6 is located underneath the bottom surface of the rear chassis 4b. The positioning of the panel 6 underneath the bottom surface of the rear chassis 4b is ensured by the provision of a resilient engaging member 14 mounted on the bottom surface of the rear chassis 4b. The engaging member 14 engages with the decorated panel 6 to firmly clamp the latter beneath the bottom surface of the rear chasis 4b.

The movement of the decorated panel 6 beneath the bottom surface of the rear chassis 4b makes it possible to move the rear chassis 4b slidably along the front chassis 4a. The rear body 1a is turned upside down prior to the slide movement of the rear chassis 4b. In this case, since the rear body 1a has been pulled out to the position of the rear end portion of the rear chassis 4b, the rear body 2a can be immediately turned about 180 degrees in such a manner to fold forward relative to the guide pin 13. Thus, the rear body 1a is transformed into a van type car body with the rear door 11 positioned at the rear end portion of the car. A clearance between the seat member 9 and the front face of the rear body 1a is filled up in the following operations. The rear chassis 4b is pushed into the front chassis 4a in order to abut the front face of the rear body 1a against the rear face of the seat member 9, and in order to overlay the front side panel 5b on the front side panel 5a to keep both of them most adjacent to one another.

The transformation into the second posture of the van type has been completed as above. The change of the outer appearance is appreciable and admirable in abundance of the form change from a streamlined and smart type car into a cubic robust type car.

In the above description of the form conversion operation, the rear body 1*a* has been pulled out backward and then turned upside down. However, it may be first turned and then pushed forward toward the front chassis 4*a*. Furthermore, the transformable toy vehicle 1 has been made capable of assuming two postures, that is, hatch-back and van type cars. However, it may also be possible to make the car having two postures such as sedan type car and truck type car with no roof.

As seen from the above description of the invention, since the transformable toy car uses a chassis which can be extended or contracted along the longitudinal direction of the car, the impression of the dimension of the car is remarkedly changed because of the change of the wheel base between the front and rear wheels. Further, since the rear body is turned upside down on the chassis with the front and rear faces and the upper and lower faces thereof being exchanged, the transformation between two different outer appearances from a hatch-back type into a van type or vice versa can be readily obtained. Moreover, since the seat member is so formed on the chassis as to be capable of being moved vertically and horizontally, the seat member can take a relatively lower position at the middle of the car when converted into a hatch-back type car, and can take a relatively high position at the forward of the car when converted into a van type car. These positions of the seat member together with the conversion of the rear body draw attention because of the multiplied conversion effects.

The transformable toy vehicle in accordance with the present invention has many other advantages. Since the toy vehicle is provided with a chassis which is separated into front and rear portions each being formed in slidable engagement with one another, the extension or contraction of the chassis along the longitudinal direction can be easily carried out. Moreover, a distinctable difference of the outer appearances sufficient for the transformable toy vehicle can be varied by setting various length of the slide between the front and rear portions of the chassis.

Since the transformable toy vehicle in accordance with the present invention is provided with the guide grooves at both sides of the rear body which guide grooves engage with the guide pins, and the rear body is movable along the entire length of the guide grooves and is capable of being turned about the guide pins at both extremities, therefore, the turning operation of the huge rear body occupying almost half of the car volume can be readily attained by employing the extending and contracting operations. Furthermore, the formation of the two different outer appearances on the surface of the rear body, such as hatch-back appearance on one side and a van type appearance on the other side, can be relatively freely accomplished without restraining the freedom of the design of the appearance.

In addition to the above advantages, since the transformable toy vehicle in accordance with the present invention is provided with a seat member which is rotatably mounted through the link member on the pivot arm, the end portion of the pivot arm being disposed at the central part of the chassis, the range of movement of the seat member is set within the range of an arc having a radius equal to the sum of the lengths of the pivot arm and the link member. Therefore, the seat member, in the case of transformation, can be moved from the front end portion to the central portion of the chassis, resulting in a considerable outer appearance change.

Although the invention has been described in its preferred form with a certain degree of particularity, it is understood that the present disclosure of the preferred from has been changed in the details of construction and the combination and arrangement of parts may be restored to without departing from the spirit and the scope of the invention as hereinafter claimed.

What is claimed is:

1. A transformable toy vehicle comprising:

a chassis comprising front and rear chassis slidably engaged with each other for extension and contraction along the longitudinal direction of said toy vehicle;

a rear body of said toy vehicle mounted on said rear chassis for turning upside down and reversing front and rear faces to assume different outer appearances for top and rear faces and for bottom and front faces, respectively, said rear body being formed with guide grooves at both side faces thereof for engagement with guide pins mounted on said rear chassis, and said rear body being capable of being moved along the entire length of said guide grooves and being turned upside down at the extremeties of said grooves about said guide pins; and a seat member mounted generally centrally on said rear chassis for moving vertically and horizontally relative to said rear chassis.

2. A transformable toy vehicle comprising:

a chassis comprising front and rear chassis slidably engaged with each other for extension and contraction along the longitudinal direction of said toy vehicle;

a rear body of said toy vehicle mounted on said rear chassis for turning upside down and reversing front and rear faces to assume two different outer appearances for top and rear faces and for bottom and front faces, respectively;

and a seat member mounted through a link member on the end portion of a pivot arm mounted on said rear chassis generally centrally thereof for moving vertically and horizontally relative to said rear chassis.

* * * * *